US007226091B2

(12) United States Patent
Amy

(10) Patent No.: US 7,226,091 B2
(45) **Date of Patent: *Jun. 5, 2007**

(54) DOOR CATCH

(76) Inventor: Ron Amy, P.O. Box 263, Penngrove, CA (US) 94951-0263

( * ) Notice: Subject to any disclaimer, the term of this patent is extended or adjusted under 35 U.S.C. 154(b) by 0 days.

This patent is subject to a terminal disclaimer.

(21) Appl. No.: 11/225,938

(22) Filed: Sep. 13, 2005

(65) Prior Publication Data

US 2006/0009317 A1 Jan. 12, 2006

Related U.S. Application Data

(63) Continuation-in-part of application No. 10/739,647, filed on Dec. 18, 2003, now Pat. No. 6,942,256.

(51) Int. Cl.
*E05C 19/10* (2006.01)
*E05C 17/04* (2006.01)

(52) U.S. Cl. ..... 292/100; 292/262; 292/DIG. 15; 16/82

(58) Field of Classification Search ..... 292/100, 292/202, 262, 275, DIG. 15, DIG. 56; 16/82; 403/115

See application file for complete search history.

(56) References Cited

U.S. PATENT DOCUMENTS

| | | | | |
|---|---|---|---|---|
| 326,373 | A | 9/1885 | Zimmerman | |
| 924,081 | A | 6/1909 | Loev | |
| 1,158,658 | A | 11/1915 | Ebert | |
| 1,198,227 | A * | 9/1916 | Hinchey | 292/251.5 |
| 1,573,272 | A | 2/1926 | Phillips | |
| 2,093,039 | A | 9/1937 | Eamon | |
| 2,111,870 | A | 3/1938 | Nemec | |
| 2,121,766 | A | 6/1938 | Wicks | |
| 2,298,176 | A | 10/1942 | Nath | |
| 2,449,686 | A | 9/1948 | Brinda | |
| 2,496,691 | A | 2/1950 | Berry | |
| 2,885,237 | A | 5/1959 | Heyer | |
| 3,086,803 | A | 4/1963 | Wilson | |
| 3,212,740 | A | 10/1965 | Greenberg | |
| 3,375,044 | A * | 3/1968 | Peterson | 403/77 |
| 3,399,918 | A * | 9/1968 | Nagy | 292/136 |
| 3,966,245 | A * | 6/1976 | Losenno | 292/202 |
| 4,762,351 | A * | 8/1988 | Bowman | 292/263 |
| 4,852,919 | A * | 8/1989 | Nimee et al. | 292/251.5 |

(Continued)

*Primary Examiner*—Brian E. Glessner
*Assistant Examiner*—Carlos Lugo
(74) *Attorney, Agent, or Firm*—Craig M. Stainbrook; Stainbrook & Stainbrook, LLP

(57) ABSTRACT

An improved rattle-free door catch is provided. The apparatus includes a catch retaining assembly having wall mounting plate with a concave ball-retaining member integral with its front side. The concave ball-retaining member includes a keyhole-shaped slot including a lower vertical portion and an upper open portion. A swivel ball is disposed within the concave ball-retaining member, and a rigid Catch retainer arm is affixed to the swivel ball at one end. At its other end, the rod has a ball cup, which includes an open end, a cylindrical lower interior portion, and a domed-shaped upper interior portion. The catch retaining assembly interacts with a catch assembly, which includes a catch mounting plate, an arcuate catch ball arm disposed from and terminating at one end in the front side of the catch mounting plate, and having a spherical catch ball disposed at another end. The catch ball is sized to fit snugly within the ball cup to create a non rattling fit.

12 Claims, 11 Drawing Sheets

U.S. PATENT DOCUMENTS 5,241,725 A * 9/1993 Hamatani et al. ..... 16/82
5,273,326 A * 12/1993 Kinkaide ..... 292/272
5,899,167 A * 5/1999 Furman ..... 116/173

* cited by examiner

DOOR CATCH

CROSS REFERENCE TO RELATED APPLICATIONS

The present application is a CIP and claims the benefit of the filing date of U.S. Utility patent application Ser. No. 10/739,647, filed Dec. 18, 2003 (Dec. 18, 2003) now U.S. Pat. No. 6,942,256.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to door catches, and more particularly to a non rattling door catch.

BACKGROUND INFORMATION AND DISCUSSION OF RELATED ART

Door catches are well known. They are used to help keep a door or the like in the open or closed position. The most common form of door catch includes a first eye hook that radially retains a J-shaped hook which can be screwed into a wall as well as a second eye hook that screws into a door or the like and can receive the end of the J-shaped hook. These parts are typically made of formed rod like steel.

Although the standard J hook catch is effective in most cases, when used in a moving vehicle or vessel such as a recreational vehicle or a boat, the loose fit of the mating J-hook and eye screw cause an annoying rattling sound.

BRIEF SUMMARY OF THE INVENTION

The present invention is a door catch that does not rattle when in use on a moving vehicle or vessel such as a boat or recreational vehicle or aircraft or the like.

It is therefore an object of the present invention to provide an improved door catch having a substantially spherical male element and cup shaped female element.

It is a further object of the present invention to provide a door catch that can retain a door in the open or closed position at a variety of parallel and non-parallel angles between a door and a wall or door frame.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a door catch comprising: a catch retainer assembly and a catch. The catch retainer assembly includes a rigid first ball-retaining mounting plate, a first ball, a rigid J-shaped rod and a second ball-retaining cup shape. The catch includes a door mounting plate and an L-shaped rod terminating at one end in the door mounting plate and at the opposite end in a second ball. The catch retainer assembly mounting plate and catch mounting plate each include a plurality of screw receiving apertures. The J-shaped rod terminates at its top portion in the second ball retaining cup and at the lower portion in the first ball. The first ball retaining plate includes a centrally disposed concave ball retaining portion which includes a vertically disposed slot capable of receiving the J-shaped rod, and the ball retaining cup is capable of fitting snugly over the second ball shape so that no rattling can occur between the retaining cup and the second ball.

In an alternative preferred embodiment, the door catch of the present invention includes a concave-ball retaining portion with a fixed pin in its base. The first ball is a swivel ball having a groove aligned with the J-shaped rod itself, and into which the fixed pin is inserted so as to stabilize the J-shaped rod and limit the possible axes of movement. The concave ball-retaining member is also provided with a keyhole-shaped slot having a vertical portion and an open upper portion, the former permitting the J-shaped rod to hang vertically when not in use, and the latter permitting the J-shaped rod to move horizontally in a 180 degree arc while also moving vertically approximately 30 degrees above and below the horizontal. This facilitates capture of a catch portion from a variety of angles.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

Drawing Legend

Figure 1:
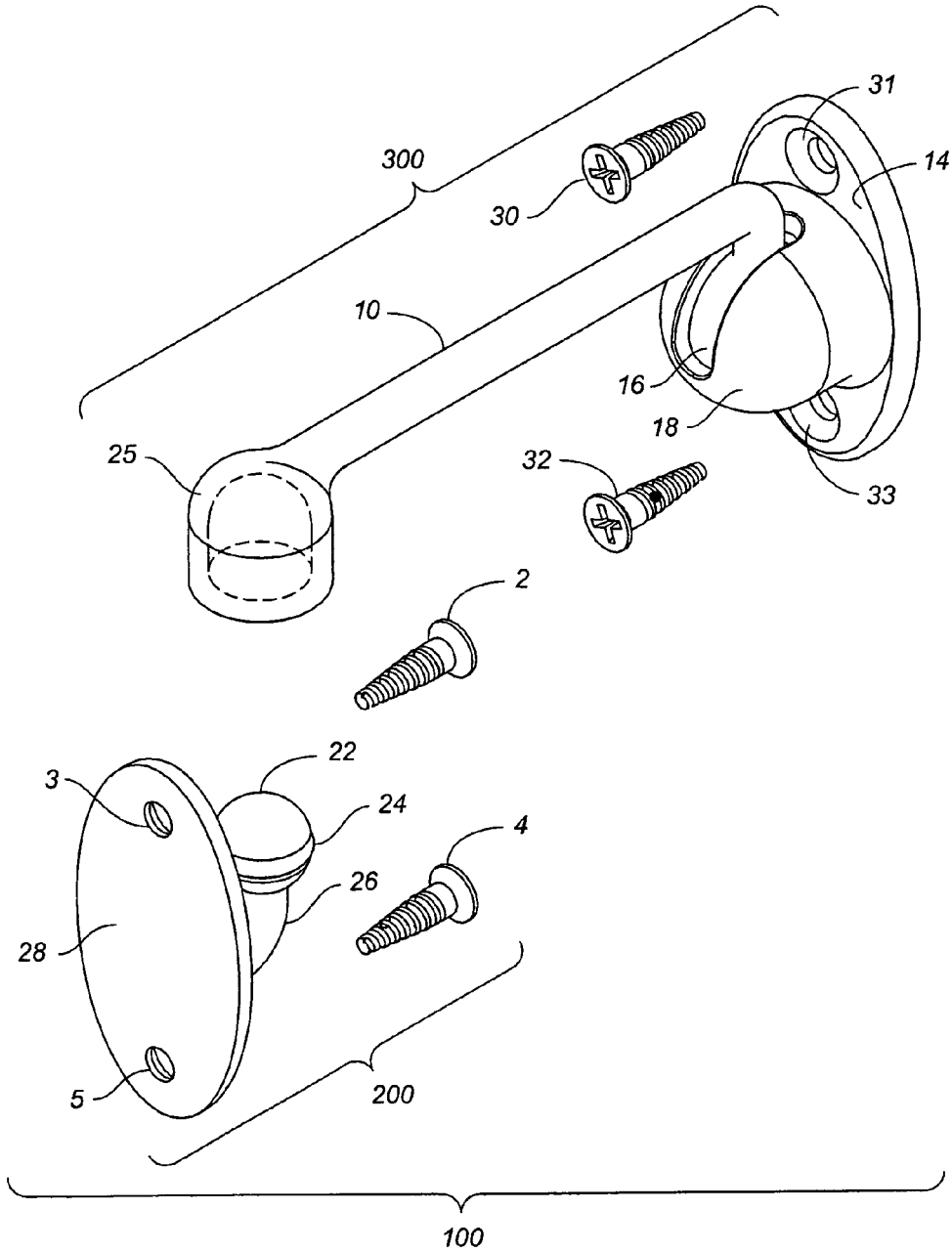
FIG. 1 is a perspective view of the catch and catch retainer of the invention.

| | |
|---|---|
| 2 | screw |
| 3 | aperture |
| 4 | screw |
| 5 | aperture |
| 10 | J-shaped rod (catch retainer arm) |
| 12 | swivel ball |
| 13 | press fit portion |
| 14 | wall mounting plate |
| 15 | aperture in swivel ball |
| 16 | vertical slot |
| 17 | 180 degree slot |
| 18 | concave ball-retaining member |
| 19 | downward direction of catch retainer arm swing |
| 20 | wall |
| 22 | catch ball |
| 24 | 0-ring |
| 25 | ball cup |
| 26 | catch ball arm |
| 28 | catch ball mounting plate |
| 30 | screw |
| 31 | aperture |
| 32 | screw |
| 33 | aperture |
| 34 | door |
| 35 | retaining disk |
| 36 | door opening |
| 40 | hinge |
| 100 | present invention, generally |
| 300 | first preferred embodiment of catch retaining assembly |
| 200 | catch assembly |
| 220 | outward direction of door opening |
| 240 | door frame |
| 260 | door |
| 400 | second preferred embodiment of catch retaining assembly |
| 500 | third preferred embodiment of catch retaining assembly |
| 510 | J-shaped rod (catch retainer arm) |
| 512 | swivel ball |
| 514 | wall mounting plate |
| 516 | keyhole-shaped slot |
| 516a | vertical portion of keyhole-shaped slot |
| 516b | upper open portion of keyhole-shaped slot |
| 518 | concave ball-retaining member |
| 519a | upper limit of range of motion of catch retainer arm when perpendicular to wall mounting plate |
| 519b | lower limit of range of motion of catch retainer arm swing in vertical portion of keyhole-shaped slot |
| 519c | upper limit of range of motion of catch retainer arm when generally parallel to wall mounting plate |
| 520 | wall |
| 522 | catch ball |
| 524 | resilient member |
| 525 | ball cup |
| 526 | catch ball arm |
| 527 | outer edge of ball cup |

-continued

| | |
|---|---|
| 528 | catch ball mounting plate |
| 530a | dome-shaped upper interior portion of ball cup |
| 530b | cylindrical interior portion of ball cup |
| 534 | door |
| 540 | door frame |

DETAILED DESCRIPTION OF THE INVENTION

Referring now to FIGS. 1-5, there is shown and illustrated a first preferred embodiments of the door catch of the present invention 100. The invention comprises a catch retaining assembly 300 and a catch assembly 200. Both assemblies 200, 300 can be constructed of metal or plastic. The catch retainer 300 includes a wall mounting plate 14 that has a concave ball-retaining member 18 and retaining disk 35. The ball-retaining member 18 has a vertical slot 16 that allows a J-shaped rod 10, or catch retainer arm, to protrude and swivel vertically in one plane approximately one hundred and ten degrees and pivot horizontally approximately one hundred and eighty degrees. At one end of J-shaped rod is fixedly attached a cup shaped second ball-retaining portion 25.

Figure 2:
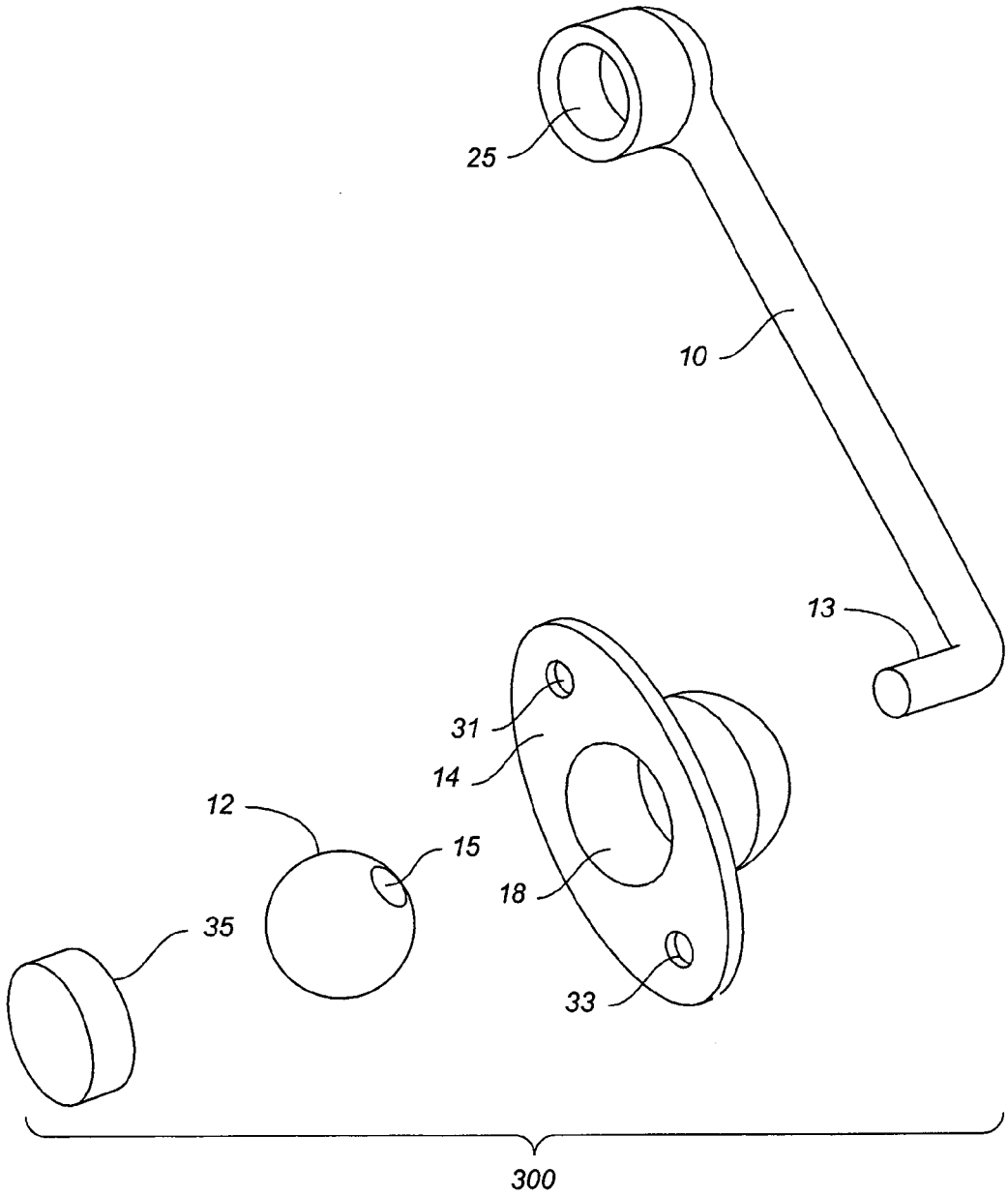
FIG. 2 is a perspective exploded view of the catch retainer assembly.

The catch 200 includes a catch ball mounting plate 28 and an L-shaped rod 26. The L-shaped rod is attached to the catch ball mounting plate 28 at one end and terminates in a catch ball 22 at its opposite end. Both the wall mounting plate 14 and the catch ball mounting plate 28 include apertures 31, 33, 3, 5 that allow screws 30, 32, 2, 4 to be inserted therethrough and thus used to attach the catch to a door and or wall or the like. Of course other retaining means may be used such as double sided adhesive tape. An O ring 24 is located around the catch ball 22. This allows for a snug fit between the interior of ball cup 25 and exterior of O ring 24. This snug fit means that there is no chance of rattling between the catch 200 and the catch retainer 300. FIG. 2 shows an exploded view of the catch retainer 300.

The catch retainer arm 10 includes a press fit portion 13 at one end that interfaces with an aperture 15 inside a swivel ball 12. Alternately, a male and female threaded fit can be used in place of a press fit at portion 13 and 15. In yet another alternative, the press fit portion may comprise a cuboid end that is inserted into a matching hole in the swivel ball. It can be affixed in any of a number of well known means, and thereby resists reorientation of the ball relative to the catch retainer arm relative to the swivel ball.

Figure 3:
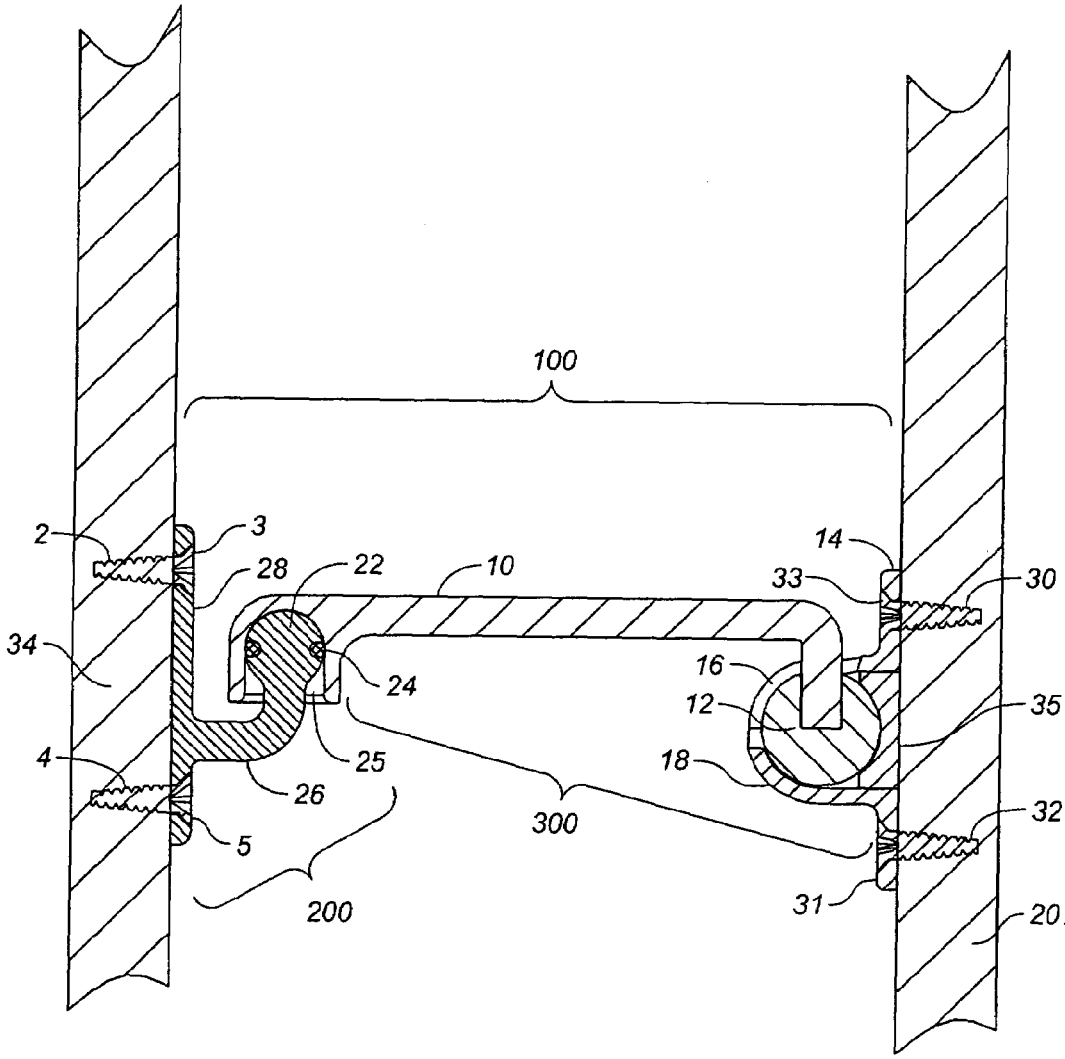
FIG. 3 is a side section view of the invention.

Swivel ball 12 fits snugly into concave portion 18 on one side and concave disk 35 on the opposite side which in turn is pressed against wall 20 as shown in FIG. 3 thereby holding the swivel ball 12 securely in place.

FIG. 3 shows a side section view of the first preferred embodiment. Catch 200 can be seen as screwed onto door 34. The interior of ball cup portion 25 can be clearly seen as can the O ring 24. Because catch ball 22 is spherical, it can interact with ball cup 25 at a variety of angles vertically and horizontally so that catch ball mounting plate 28 can be mounted at a variety of angles. This allows the relationship between the door 34 and the wall 20 to be something other than parallel. Slot 16 keeps J-shaped rod 10 from twisting thereby insuring that ball cup 25 is always in the proper orientation with respect to catch ball 22 and L-shaped catch ball holding member 26.

Figure 4:
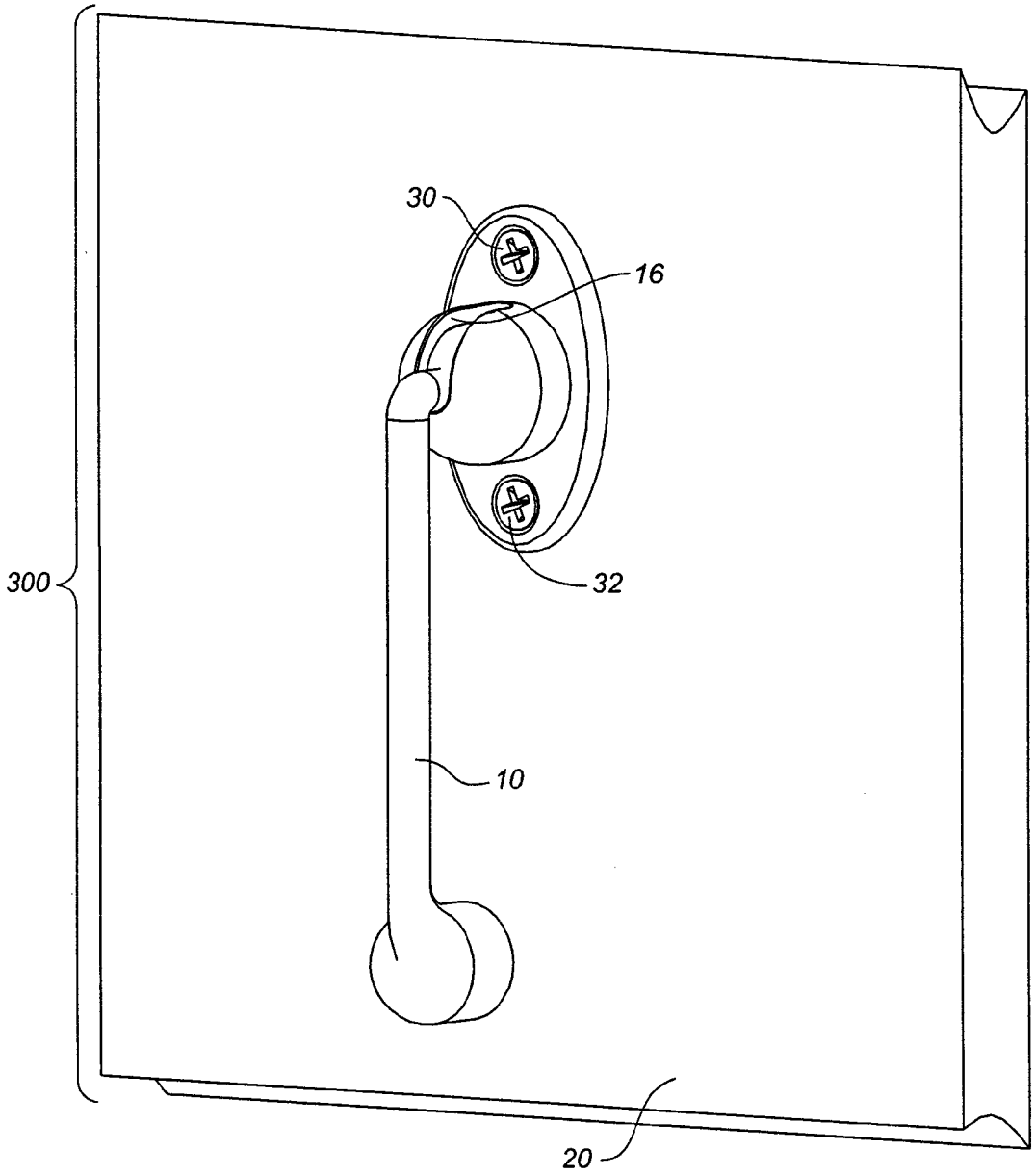
FIG. 4 is a perspective view of the catch retaining assembly rotated down in the non use position.

FIG. 4 shows a perspective view of the catch retainer assembly 300 where the J-shaped rod 10 is rotated down to the lower limit of slot 16 and automatically centered in its rest position when not in use.

Figure 5:
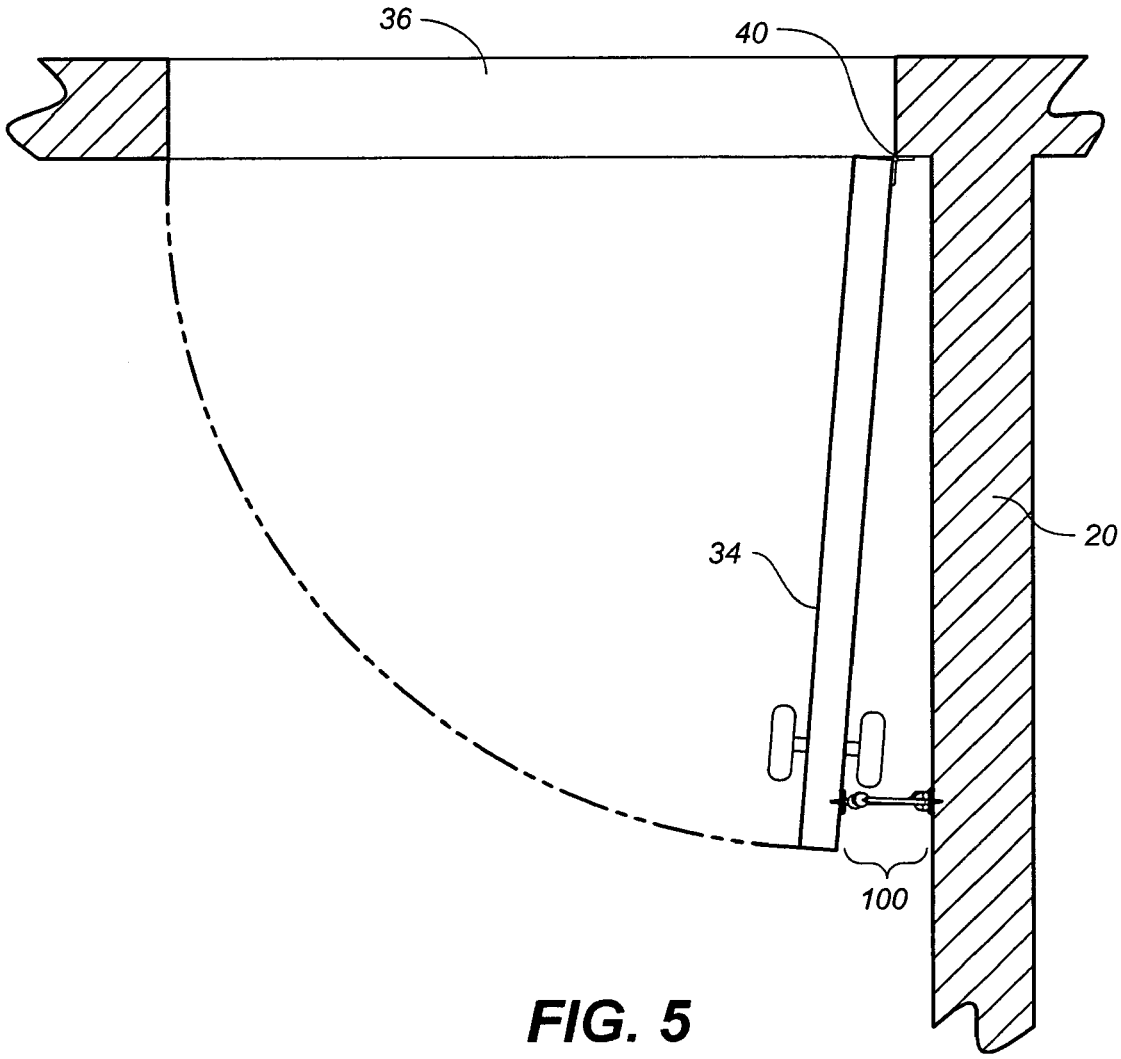
FIG. 5 is a top view of the present invention in place on a door and a wall.

FIG. 5 shows a top view of the first preferred embodiment of the door catch of the present invention 100 in use between a door 34 and a wall 20. The door 34 includes a hinge 40 and is in the open position so that the door opening 36 is suitable for ingress and egress.

Figure 6:
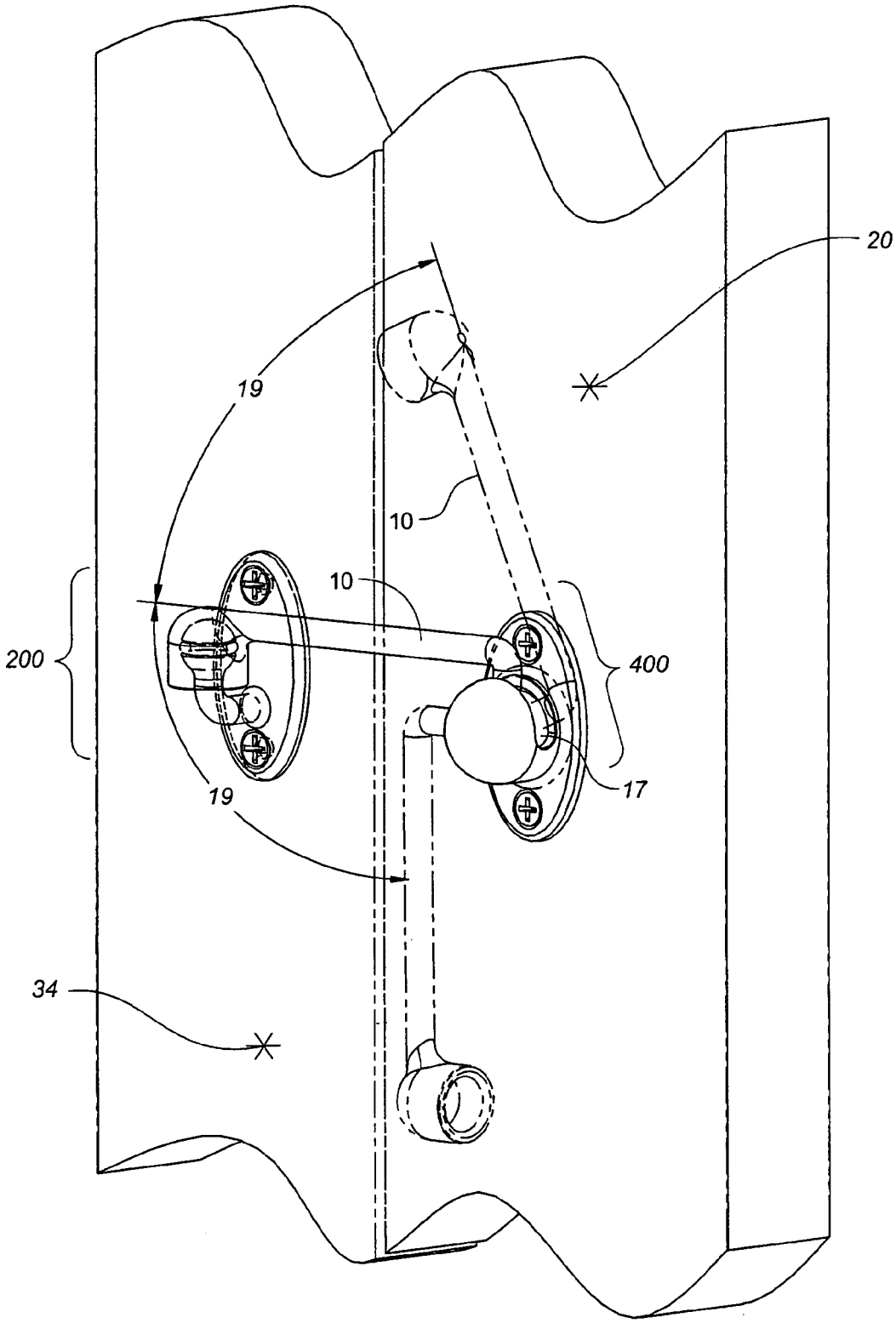
FIG. 6 is a perspective view of an alternative latch-type embodiment of the catch retaining assembly of the present invention.

FIG. 6 shows a second preferred embodiment of the catch retaining assembly 400 wherein the one hundred and eighty degree slot 17 is parallel to wall 20 rather than perpendicular as in the first preferred embodiment, shown in FIGS. 1 through 5. This orientation allows J-shaped rod 10 to swing down 19 parallel to wall 20 and door 34 thereby allowing the invention to act as a latch to hold a door or the like in the closed position rather than a catch that is meant to hold a door or the like in an open position.

Figure 7:
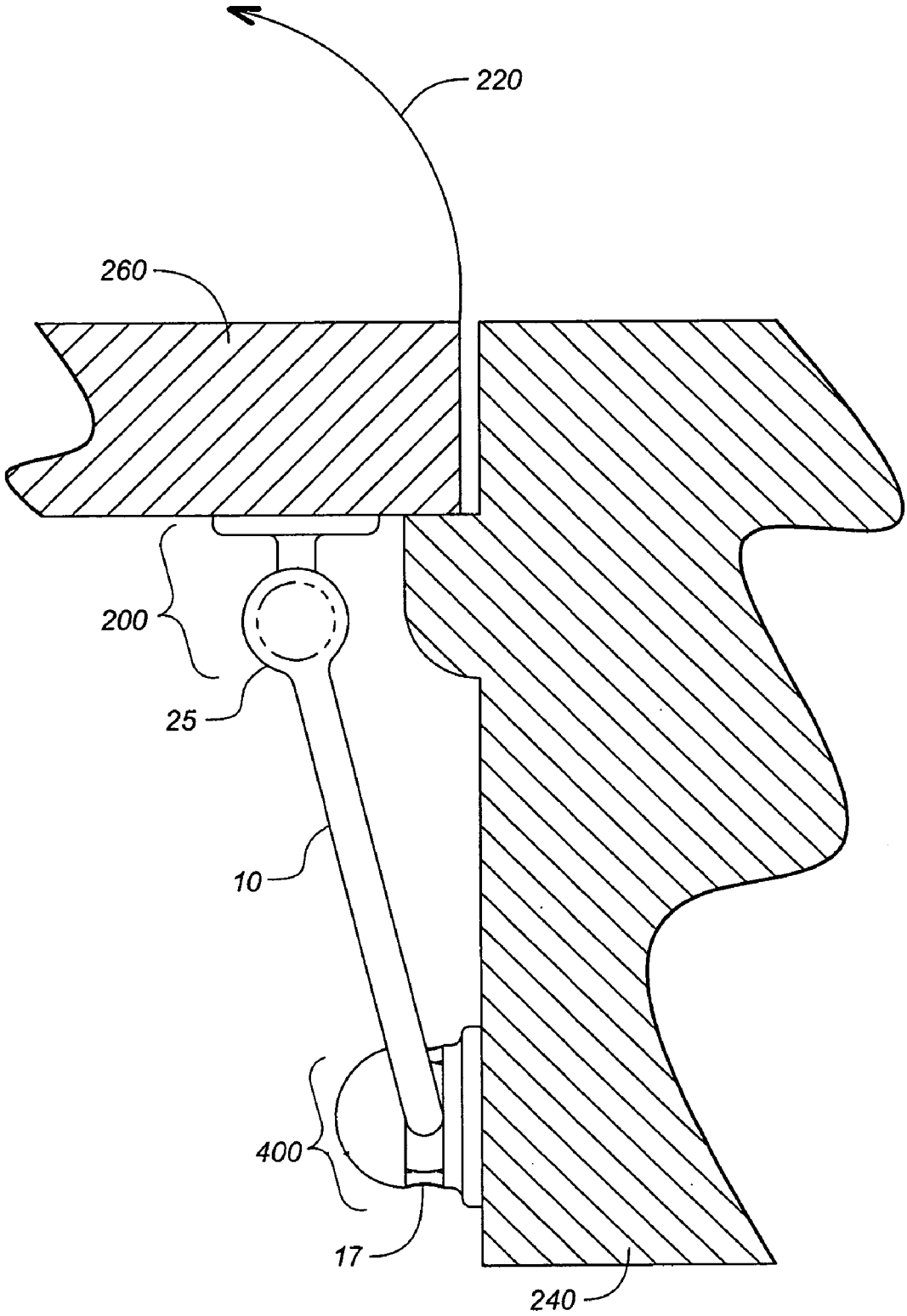
FIG. 7 is a top view of the latch-type catch retaining assembly mounted on a door frame and employed to catch a catch ball mounted on a door.

FIG. 7 is a top view of the second preferred embodiment described above, wherein the catch retaining assembly 400 is mounted to a door frame 240 at a ninety degree angle to catch assembly 200 mounted on door 260 and opening out as shown by radial line 220. The catch retainer arm 10 can be positioned to the right or the left to accommodate left or right opening doors. Because of the snug fit between the catch and the catch retainer as described above, the chance of rattling is significantly reduced. This feature is important when the invention is used in a boat or recreational vehicle or aircraft.

FIGS. 8-11 show yet another possible embodiment 500 of the catch retaining assembly of the door catch of the present invention. The views include, respectively, a cross-sectional side view showing the apparatus mounted on a wall 520 and employed to catch a door 534; a front perspective view; a front perspective view showing the door catch employed to catch a door 534 normal to the surface 540 on which the catch retaining plate is mounted; a rear perspective view, and a top view.

The assembly elements are generally identical to the first preferred embodiment, shown in FIGS. 1-5. The apparatus includes a catch retainer arm 510, having a swivel ball 512 disposed at one end, and a cup-shaped ball cup 525 integrally disposed at the other end. The swivel ball includes a groove 513 disposed circumferentially on the swivel ball in a generally parallel alignment with the catch retainer arm. Preferably, it extends from roughly 120 to 180 degrees of arc on the circumference of the swivel ball surface. The concave ball-retaining member 518, which is integral with wall mounting plate 514, includes a fixed pin 521, preferably a roll pin, inserted through the bottom of the ball-retaining member and is sized to insert into groove 513. The concave ball-retaining member further includes a keyhole-shaped slot 516 having a vertical portion 516*a* and an upper open portion 516*b*. A retaining disk is provided and employed in precisely the same manner as in the above-described first preferred embodiment.

The vertical portion of the keyhole-shaped slot in the concave ball-retaining member preferably tapers down such that at its lowest portion is has a width substantially equal to the diameter of the catch retainer arm 510. This forces the catch retainer arm to center and fix itself when in the down position at the lowest point 519*a* in its range of motion when moved in the vertical slot. Accordingly, when in the down position 519*a*, the catch retainer arm does not swing from side to side and is thereby positioned and stable in a substantially locked position.

Figure 8:
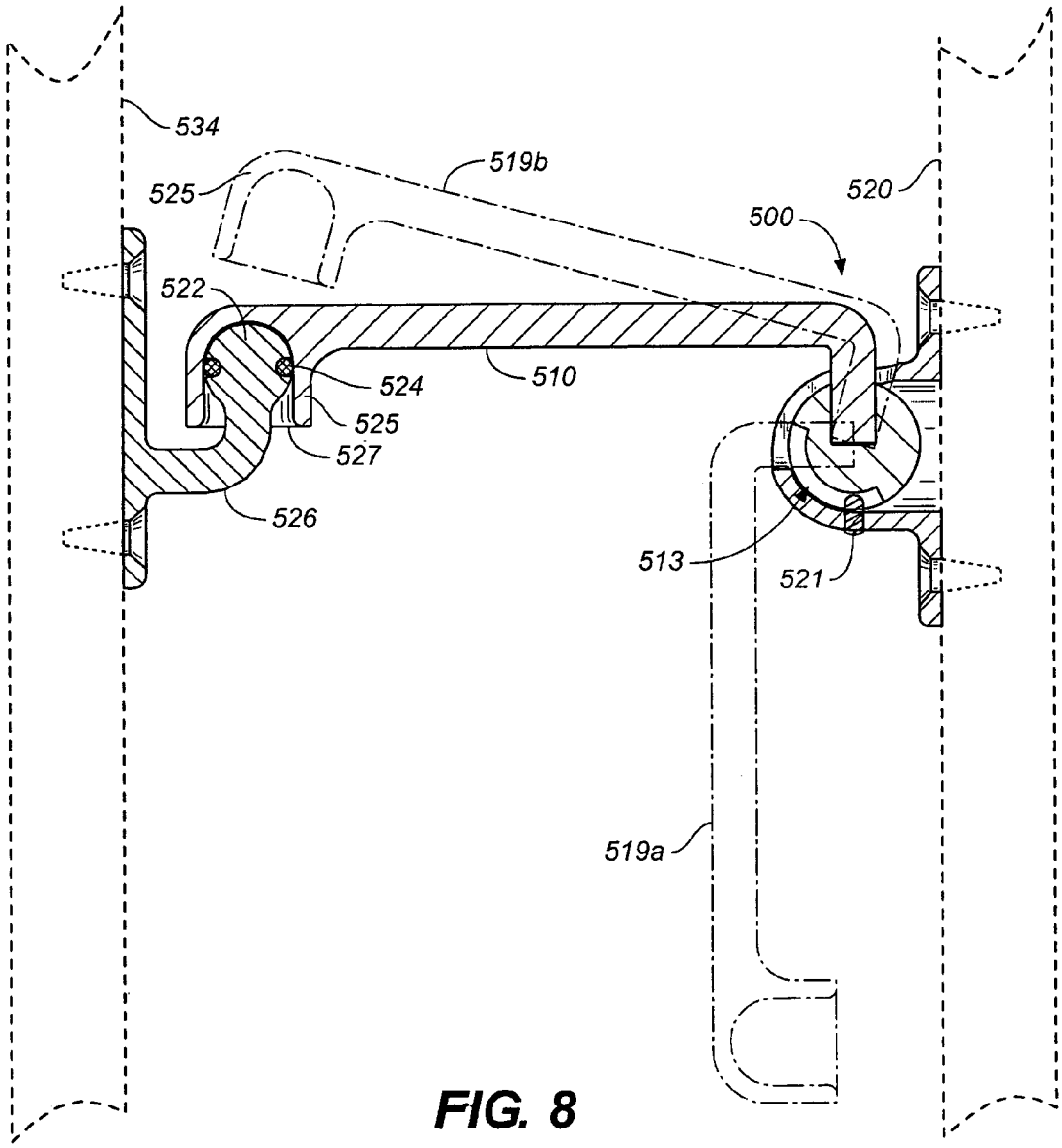
FIG. 8 is a cross-sectional side view in elevation of still another alternative embodiment of the catch retaining assembly of the door catch of the present invention.
Figure 9A:
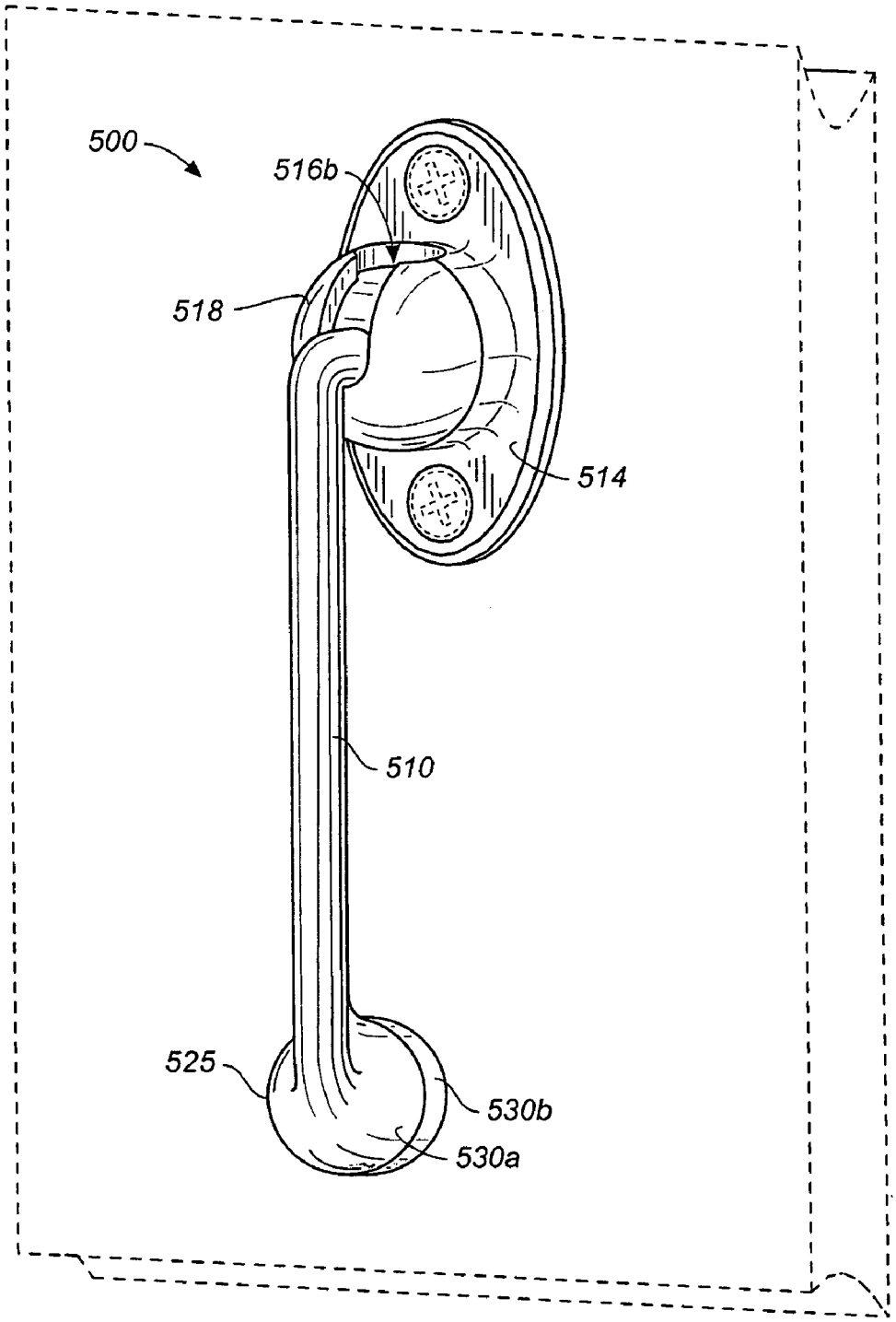
FIG. 9A is a front perspective view thereof.
Figure 9B:
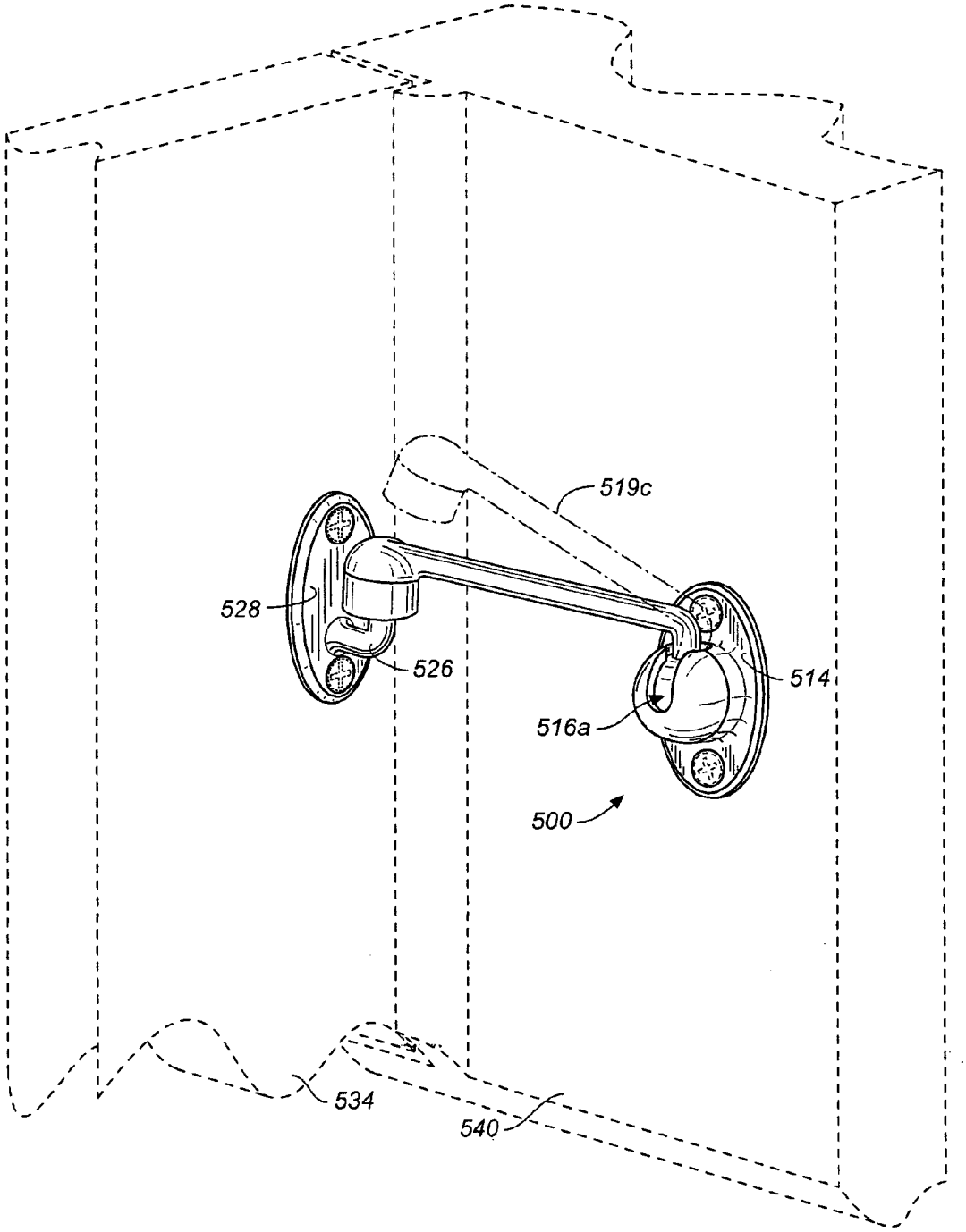
FIG. 9B is a front perspective view thereof showing the door catch employed to latch a door disposed at 90 degrees relative to the wall or door frame on which the catch retaining plate is mounted.
Figure 10:
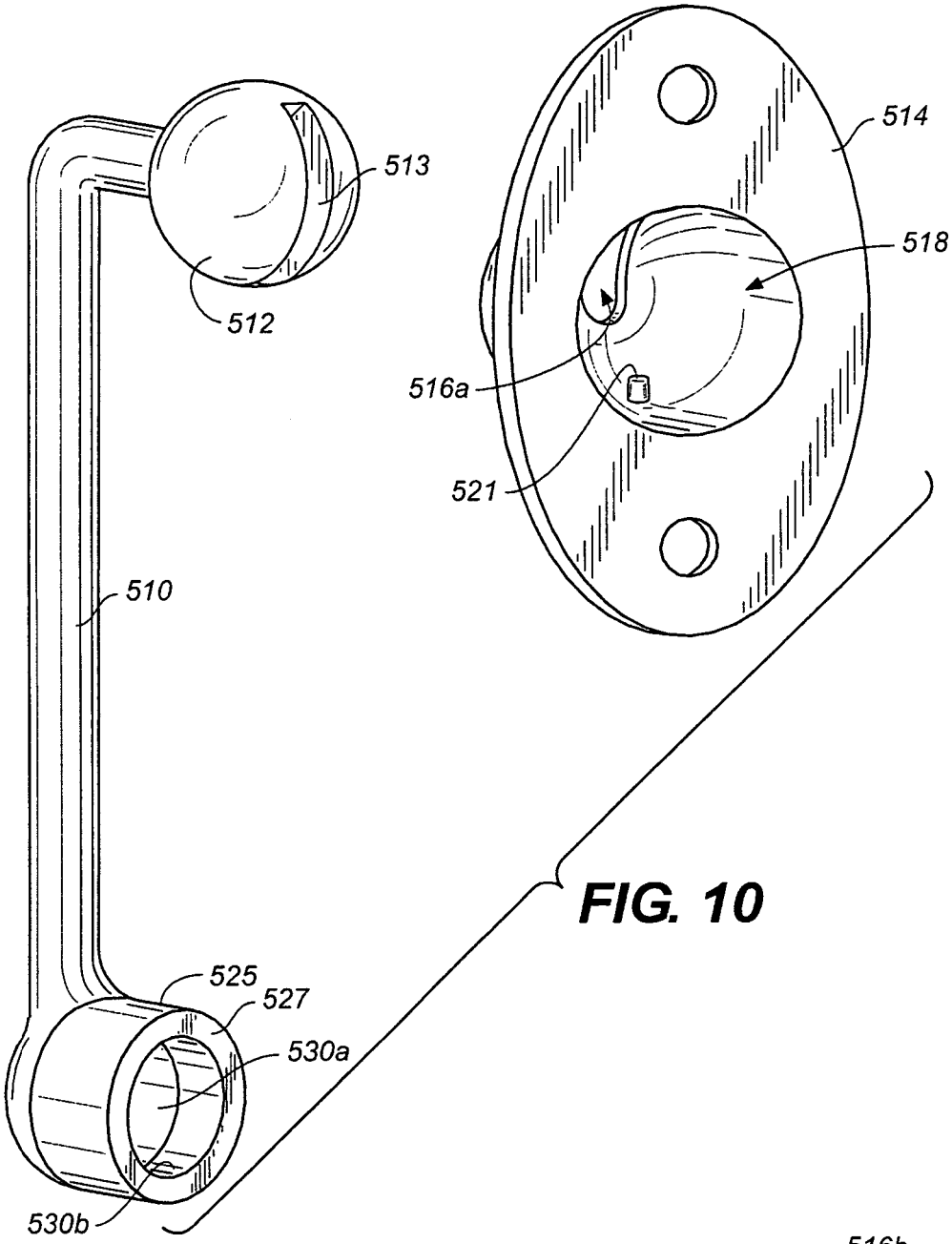
FIG. 10 is a rear perspective view thereof (not showing the retaining disk)
Figure 11:
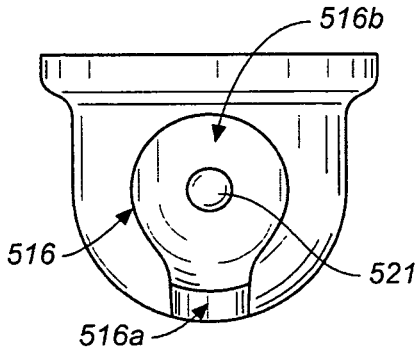
FIG. 11 is a top view thereof.

The circumferential groove 513 in swivel ball 512 provides a track in which the fixed pin 521 moves. Thus, the swivel ball 512 can only operate in two axes: vertically within both the vertical portion 516*a* and the upper open portion 516*b* of keyhole-shaped slot 516; and horizontally within an arc determined by the arc of the upper opening 516*b* of the keyhole slot 516 and groove 513. The upper ranges of motion, 519*b*, 519*c*, are shown in FIGS. 8 and 9B, These elements cooperate to ensure that when the ball cup 525 captures a catch ball 522 disposed upwardly on a catch ball arm 526, the catch retainer arm 510 maintains a vertical orientation regardless of any other movement in the other two axes, thereby acting as a kind of gooseneck or universal joint. The fixed pin in the concave ball-retaining member 518 and the groove 513 in the swivel ball 512 provide a third axis limitation. Preferably the catch retainer arm is securely press fit and otherwise fixed in swivel ball 512, such that catch retainer arm 510 cannot rotate within the swivel ball and thereby maintains proper alignment with the groove 513 in the swivel ball and also keeps ball cup 525 in a vertical orientation at all times.

Furthermore, the elements of the assemblies are sized so as to ensure that once the ball cup 525 engages the catch ball 522, there is no change in clearances between the ball cup and the catch ball as the ball cup is firmly seated. This is made possible by matching the radius of the catch ball with both the dome-shaped upper interior portion 530*a* of the ball cup and the interior cylindrical portion 530*b* of ball cup. Accordingly, the catch ball may be engaged by the ball cup from a virtually infinite number of angles, the one limitation being that the ball cup cannot approach and seat on the catch ball in such a fashion that the outer edge 527 of the ball cup is prevented from fully seating on the catch ball by the catch ball arm.

Accordingly, in its most essential aspect, the present invention is a door catch having male and female elements that interact with one another to provide a rattle-free capture of a hinged door from a multiplicity of angles or orientations. The two specially conformed male and female elements include: (1) a rounded female element comprising a ball cup 525 with a domed upper and cylindrical lower interior surface, 530*a*, 530*b*, respectively, the ball cup being integrally affixed to the end of an arm 510 which is pivotally and/or swivellingly mounted on a wall or door frame; and (2) a rounded male element comprising a spherical catch ball 522. These elements are sized to engage one another such that the clearance between catch ball and ball cup is maintained as the ball cup swings through the arc of the catch retainer arm and into removable engagement with the catch ball. Because the interior dimensions of the ball cup are sized to match the catch ball, a perfect fit is maintained from the first moment of engagement and thereafter to within an arc of about 30 degrees above or below the horizontal. This creates a rattle-free capture of the male element by the female element. In the preferred embodiments, roughly a 60 degree arc of engagement can be achieved before the outer edge of the ball cup interferes with the catch ball arm.

In another aspect, it will be seen that the essential inventive apparatus is a door catch including: (1) a wall mount; (2) a catch retainer arm swivellingly attached at one end to the wall mount and having, (3) a concave female ball cup disposed at its other end, the ball cup having interior portions including a lower cylindrical portion and an upper dome-shaped portion; (4) a door mount; (5) a catch ball arm extending outwardly from the door mount; (6) a spherical catch ball disposed on one end of the catch ball arm and having a radius matching the radius of the interior of the ball cup.

The foregoing characteristics and features distinguish the present invention over conventional door hooks, as the latter require a large hole on the eye portion to allow the hook to swing into the eye hole. This results in a loose fit between the eye and the hook when the hook arm reaches a horizontal position with the hook portion perpendicular to the hole in eye mount. The result is that movement of the door under the effect of wind, vibration, or environmental movement causes the hook to rattle in the larger eye hole.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

For instance, it will be appreciated by those with skill in the art that resilient member 524 may comprise any of a number of suitable shapes and forms. For instance, as set out above, resilient member may be an O-ring disposed around the circumference of catch ball 522. However, it is not essential that the resilient member be disposed around the entire circumference of the catch ball to provide the rattle-free fit that dampens and quiets the catch retainer arm as it rests on the catch ball. Indeed, any manner of protuberance could be disposed on the surface of the catch ball to provide the secure fit for the ball cup. Furthermore, the catch ball itself could be fabricated from a slightly resilient material, thereby obviating the need to dispose anything around its surface. For example, the catch ball could be fabricated from neoprene or a material having similar deformation characteristics. This would permit some deformation or displacement of the outer portion of the catch ball to accommodate the ball retaining cup while allowing a firm fit and capture of the swivel ball within the ball cup. Alternatively, the interior of the ball cup could be lined with deformable material, and the catch ball fabricated of generally rigid material. The essential feature is that the materials of the catch ball and the ball cup cooperate to provide a rattle free fit, with or without surface features on the catch ball.

Therefore, the above description and illustrations should not be construed as limiting the scope of the invention, which is defined by the appended claims.

The invention claimed is:

1. A door catch comprising:

a wall mounting plate having a front side and a substantially planar back side, said wall mounting plate for attachment to a first structural surface;

a concave ball-retaining member integral with said front side, said concave ball-retaining member having a keyhole-shaped slot including a lower vertical portion and an upper open portion;

a substantially spherical swivel ball swivellingly disposed within said concave ball-retaining member;

a rigid elongate catch retainer arm affixed at one end to said swivel ball and extending through said keyhole-shaped opening;

a ball cup integral with said catch retainer arm at an end opposite that of the end to which said swivel ball is affixed, said ball cup having an open end, and interior portions including a cylindrical lower interior portion, and a domed-shaped upper interior portion;

a catch mounting plate having a front side and a substantially planar back side, said catch mounting plate for attachment to a second structural surface;

an arcuate catch ball arm disposed from and terminating at one end in said front side of said catch mounting plate, and having a substantially spherical catch ball disposed at another end, said catch ball sized to fit snugly within said ball cup to create a non rattling fit;

wherein a range of movement of said catch retainer arm is defined by the shape and dimensions of the keyhole-shaped slot in said concave ball-retaining member; and at least one resilient member disposed on the surface of said catch ball.

2. The door catch of claim 1, wherein said resilient member is an O-ring.

3. The door catch of claim 2, wherein said resilient member comprises a plurality of resilient protuberances circumferentially disposed in a generally horizontal orientation around said catch ball.

4. The door catch of claim 1, wherein said catch ball is fabricated from resilient material.

5. The door catch of claim 1, wherein said ball cup includes a resilient interior surface.

6. The door catch of claim 1, wherein the radius of said catch ball is substantially the same as the radius of said cylindrical lower interior portion and said domed-shaped upper interior portion of said cup ball.

7. The door catch of claim 1, wherein said catch ball and said interior portions of said ball cup are sized such that the clearance between said catch ball and said interior portions of said ball cup is maintained as the ball cup swings through an arc on said catch retainer arm and into complete removable engagement with said catch ball.

8. A door catch comprising:

a wall mounting plate having a front side and a substantially planar back side, said wall mounting plate for attachment to a first structural surface;

a concave ball-retaining member integral with said front side, said concave ball-retaining member having a keyhole-shaped slot including a lower vertical portion and an upper open portion;

a substantially spherical swivel ball swivellingly disposed within said concave ball-retaining member;

a rigid elongate catch retainer arm affixed at one end to said swivel ball and extending through said keyhole-shaped opening;

a ball cup integral with said catch retainer arm at an end opposite that of the end to which said swivel ball is affixed, said ball cup having an open end, and interior portions including a cylindrical lower interior portion, and a domed-shaped upper interior portion;

a catch mounting plate having a front side and a substantially planar back side, said catch mounting plate for attachment to a second structural surface;

an arcuate catch ball arm disposed from and terminating at one end in said front side of said catch mounting plate, and having a substantially spherical catch ball disposed at another end, said catch ball sized to fit snugly within said ball cup to create a non rattling fit;

wherein a range of movement of said catch retainer arm is defined by the shape and dimensions of the keyhole-shaped slot in said concave ball-retaining member; and a fixed pin disposed from the bottom of said concave ball-retaining member, and wherein said swivel ball includes a groove on its surface which is generally aligned with said catch retainer arm and into which said fixed pin is inserted.

9. The door catch of claim 8, wherein said catch ball is fabricated from resilient material.

10. The door catch of claim 8, wherein said ball cup includes a resilient interior surface.

11. The door catch of claim 8, wherein the radius of said catch ball is substantially the same as the radius of said cylindrical lower interior portion and said domed-shaped upper interior portion of said cup ball.

12. The door catch of claim 8, wherein said catch ball and said interior portions of said ball cup are sized such that the clearance between said catch ball and said interior portions of said ball cup is maintained as the ball cup swings through an arc on said catch retainer arm and into complete removable engagement with said catch ball.

* * * * *